US008609202B2

(12) United States Patent
Koops et al.

(10) Patent No.: US 8,609,202 B2
(45) Date of Patent: Dec. 17, 2013

(54) METHOD FOR INSCRIBING OR MARKING SURFACES

(75) Inventors: Arne Koops, Neu-Lankau (DE); Sven Reiter, Hamburg (DE); Norio Arai, Machida (JP)

(73) Assignee: tesa SE, Hamburg (DE)

( * ) Notice: Subject to any disclaimer, the term of this patent is extended or adjusted under 35 U.S.C. 154(b) by 548 days.

(21) Appl. No.: 12/526,083

(22) PCT Filed: Feb. 1, 2008

(86) PCT No.: PCT/EP2008/051292
§ 371 (c)(1),
(2), (4) Date: Aug. 6, 2009

(87) PCT Pub. No.: WO2008/101790
PCT Pub. Date: Aug. 28, 2008

(65) Prior Publication Data

US 2010/0104737 A1 Apr. 29, 2010

(30) Foreign Application Priority Data

Feb. 20, 2007 (DE) ..... 10 2007 008 668

(51) Int. Cl.
*H05H 1/24* (2006.01)

(52) U.S. Cl.
USPC ..... 427/569; 427/457; 427/572; 427/596

(58) Field of Classification Search
None
See application file for complete search history.

(56) References Cited

U.S. PATENT DOCUMENTS

| | | | | |
|---|---|---|---|---|
| 4,987,006 | A * | 1/1991 | Williams et al. | 427/597 |
| 5,292,559 | A * | 3/1994 | Joyce et al. | 427/597 |
| 6,159,832 | A * | 12/2000 | Mayer | 438/584 |
| 7,159,517 | B2 * | 1/2007 | Altmann et al. | 101/483 |
| 2003/0218670 | A1 * | 11/2003 | Steenackers | 347/243 |
| 2004/0206263 | A1 | 10/2004 | Altmann et al. | |
| 2005/0066348 | A1 | 3/2005 | Limousin | |
| 2005/0255406 | A1 | 11/2005 | Assa | |
| 2005/0269301 | A1 * | 12/2005 | Burrowes et al. | 219/121.69 |
| 2009/0181313 | A1 * | 7/2009 | Koops et al. | 430/2 |

FOREIGN PATENT DOCUMENTS

| | | | | |
|---|---|---|---|---|
| DE | 19607621 | A1 * | 9/1997 | A61C 7/00 |
| DE | 19607621 | C2 | 9/1997 | |
| DE | 10125794 | A1 | 12/2002 | |
| FR | 2833518 | A | 6/2003 | |
| JP | 54048563 | A * | 4/1979 | B41M 5/26 |
| WO | 9925562 | A1 | 5/1999 | |
| WO | WO 99/25562 | A1 * | 5/1999 | B41M 5/24 |

OTHER PUBLICATIONS

International Search Report from the European Patent Office mailed Jul. 28, 2009.

* cited by examiner

*Primary Examiner* — Timothy Meeks
*Assistant Examiner* — Michael P Rodriguez
(74) *Attorney, Agent, or Firm* — Norris McLaughlin & Marcus, P.A.

(57) ABSTRACT

Disclosed is a method for inscribing or marking surfaces (1), especially metal surfaces. In said method, the surface (1) that is to be inscribed or marked is coated with an absorption promoter (2) in a first step, whereupon a high-energy beam (4), e.g. a laser beam, which colors the surface (1) as a result of the interaction with the absorption promoter by means of a temperature increase, is applied to surface elements that re to be inscribed or colored.

4 Claims, 3 Drawing Sheets

METHOD FOR INSCRIBING OR MARKING SURFACES

This is an application filed under 35 USC §371 of PCT/EP2008/051292, claiming priority to DE 10 2007 008 668.9 filed on Feb. 20, 2007.

BACKGROUND OF THE INVENTION

The invention relates to a method of marking or inscribing surfaces, more particularly surfaces of metals.

With metals there are a variety of marking methods known. For example a marking may be produced by means of application of material, such as with ink, or else with depletion of material, such as in the case of engraving.

It is also possible to perform what is referred to as temper marking or else oxidation marking. This means that the metal at its surface undergoes changes in color in certain areas as a result of selective temperature change. In the case of metals which are heated to a predeterminable temperature, oxidation processes on the surface give the surface a colored appearance and hence a colored coloration, inscription or marking. In this case it is possible to influence the thickness of the oxidation layer, since the diffusion of the oxygen atoms is dependent on the tempering temperature and/or the tempering time.

For example, different oxide layers on the surface exhibit an iridescent chromatic coloration of the surface. This color effect is used in stainless steel in accordance with the prior art, since at around 500° C. a dark-gray to black temper color is formed.

In order to carry out marking, lasers are used to produce a temper mark. In this operation, when the laser light is employed on the direct surface of the metal, there is a disadvantageous surface effect, since the laser light is coupled in directly on the surface and as a consequence in the zone of heat influence, there are burrs, furrows, melting events and metallurgical changes in microstructure. A surface layer is consequently roughened and/or its microstructure altered, and so, for example, there may even be instances of weakening of the material. This may be disadvantageous in particular in the case of certain fields of application, as for example in medical engineering or else in other fields of application where the desire is for particularly smooth or clean marked surfaces.

BRIEF SUMMARY OF THE INVENTION

It is an object of the invention to provide a method for marking or inscribing surfaces of metals that alleviates or avoids the disadvantages of the prior art and produces an extremely smooth marked or inscribed surface.

In accordance with the invention this is achieved with the features of claim 1. Accordingly the object is achieved by a method for marking or inscribing surfaces, such as, more particularly, metal surfaces, where the surface to be marked or inscribed is coated in a first step with an absorption promoter and subsequently a high-energy beam, such as a laser beam, for example, is applied to surface elements to be inscribed or to be marked, said beam raising the surface above a temperature which gives rise to color change.

The application of the absorption promoter is preferably preceded by cleaning of the surface.

Furthermore, it is advantageous in accordance with the invention if, after the high-energy beam has been applied, the surface is cleaned to remove residues and/or absorption promoter no longer required.

It is particularly preferred in accordance with the invention if the absorption promoter can be applied as a coating material or as an adherable or attaching film element.

It is preferred, furthermore, for there to be an intermediate layer between the absorption promoter and the surface. This intermediate layer advantageously possesses a thickness d in the range from 25 to 100 μm.

It is particularly advantageous if the absorption promoter is applied substantially only to surface regions that are subsequently to be marked or inscribed.

In accordance with a further exemplary embodiment the absorption promoter may also be applied extensively.

Advantageous developments are described in the dependent claims.

BRIEF DESCRIPTION OF THE DRAWINGS

The invention is illustrated below on the basis of an exemplary embodiment with reference to the drawing, in which.

DETAILED DESCRIPTION OF THE INVENTION

Figure 1:
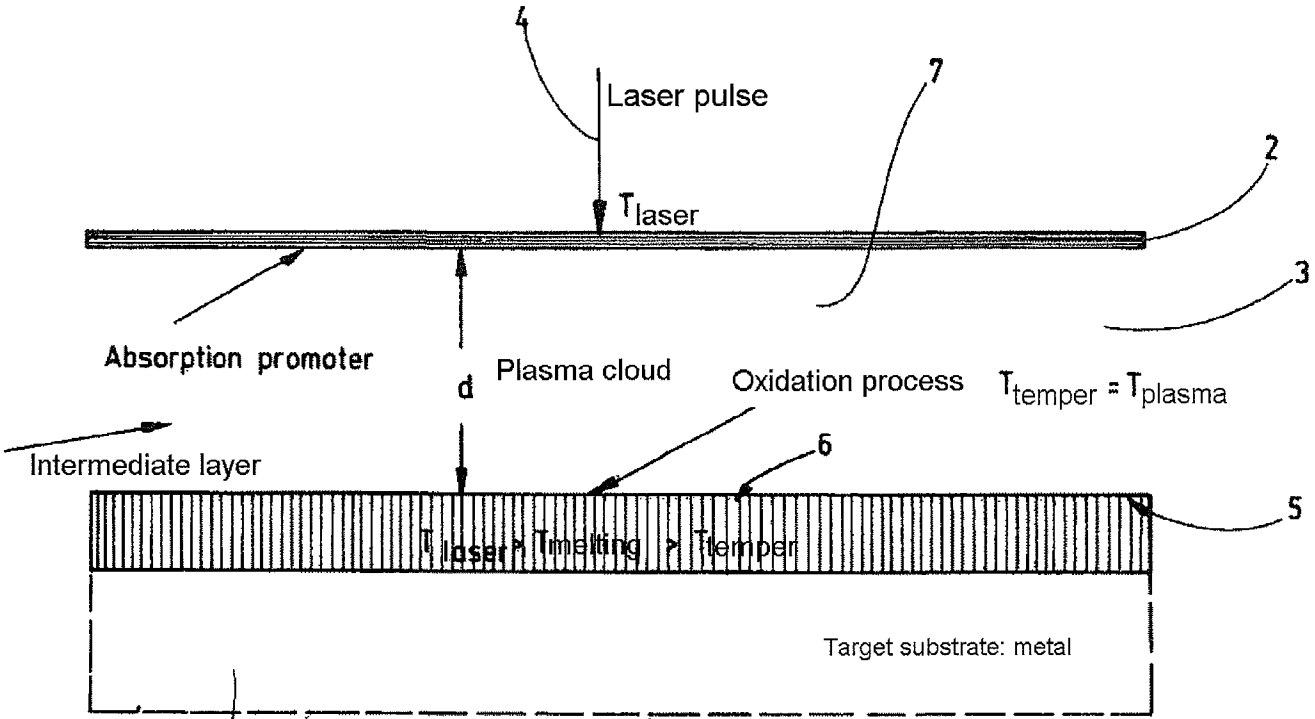
FIG. 1 shows a schematic representation of a surface to be marked or inscribed.

FIG. 1 shows diagrammatically a metal surface which is to be marked or inscribed. For that purpose a layer 2 is applied to the metal surface, the layer being composed of what is called an absorption promoter. The layer is advantageously at a distance d from the metal surface. When high-energy radiation, such as laser radiation 4, in the form for example of a laser pulse, is irradiated, the radiation or the laser light is not brought directly into contact or interaction with the metal surface, but instead, as a result of the impingement of the laser light on the layer of absorption promoter 2, the laser light is converted into heat, which acts on the metal surface 1. The absorption promoter, through absorption of the laser light, is converted locally into a plasma 3, also called plasma cloud, and the plasma 3 delivers the heat to the adjacent metal, at which point, locally, heating takes place until the tempering temperature is reached. The distance d between the absorption promoter and the metal surface serves for better propagation of the plasma or the plasma cloud. Advantageously this distance is produced by means of a film or the like. The distance is advantageously in the range of 25-100 μm. The advantageous distance may vary, however, with the beam source used, and, for example, with its power. The distance is advantageously achieved by means of an intermediate layer 7. The intermediate layer is advantageously applied together with the absorption promoter, it also being possible for the intermediate layer to be produced by means of spacers.

This has the advantageous effect that the laser pulse 4, with its high energy density per unit area, does not produce excessive temperatures on the metal surface, and hence there are no instances of local damage caused. The resulting high temperature $T_{laser}$ is hence produced not on the surface of the metal to be marked or inscribed, but rather on the surface of the absorption promoter 2. As a result of the high temperature of the light-absorbing material, the absorption promoter is converted into a plasma. This preferably takes place on a relatively local basis, thereby allowing selective marking to be performed. The plasma is brought to or produced with a temperature $T_{plasma}$. The plasma temperature $T_{plasma}$ is advantageously below the temperature $T_{laser}$ which would come about if the laser radiation impinged on the metal surface. Furthermore, the plasma temperature is advantageously situated in the temperature range of the tempering temperature, and so $T_{plasma}=T_{temper}$ or $T_{plasma}\approx T_{temper}$.

This ensures that the temperature $T_{laser}$ is kept clear of the metal surface, since it is generally greater than the melting temperature $T_{melting}$ of the metal, which in turn is greater than the tempering temperature $T_{temper}$.

As a result of the formation of the plasma 3 there is an oxidation process 6 on the surface of the metal 5 that takes place in a very controlled way, since the temperature of the plasma can be selected via the plasma-forming material of the absorption promoter. The selective oxidation on the surface of the metal therefore means that the coloring of the surface is carried out selectively.

Figure 2:
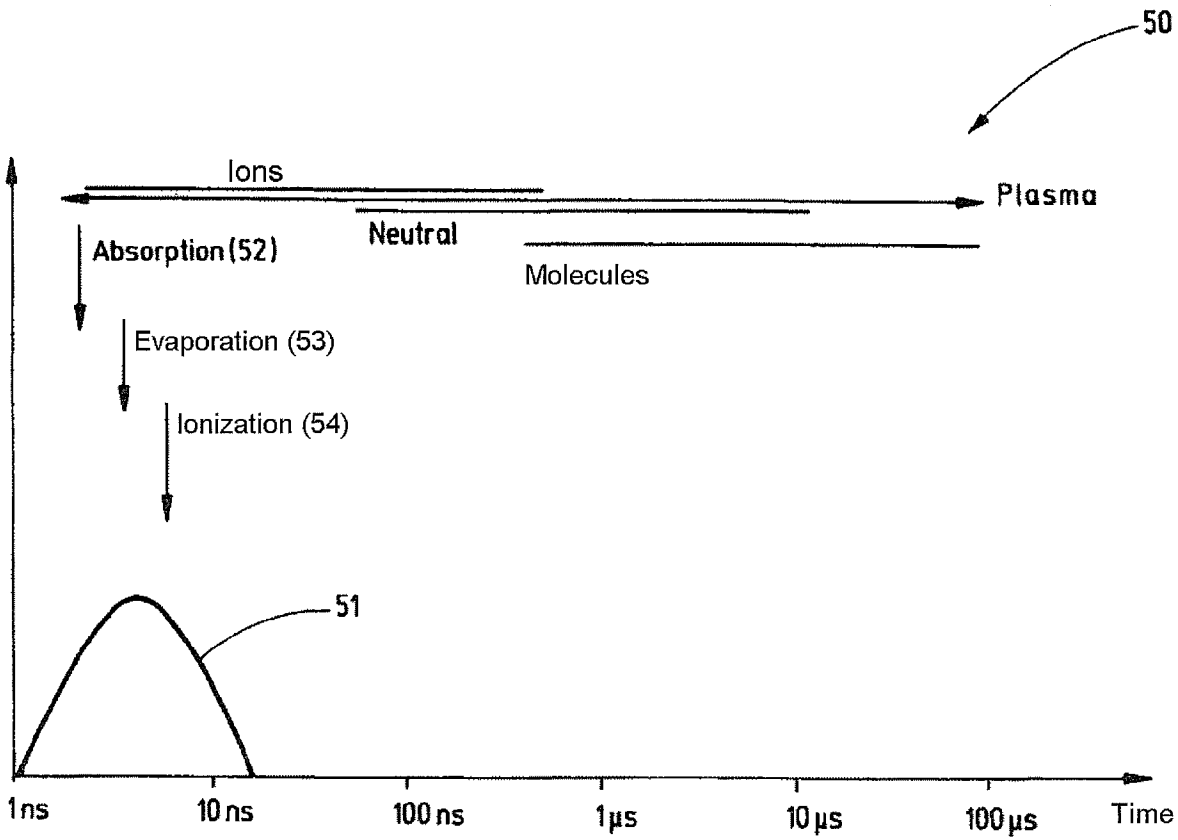
FIG. 2 shows a diagram.

FIG. 2 shows a diagram 50 in which on the x axis a time is plotted. The plot 51 represents one pulse of a laser, a laser pulse. During the pulse duration, there is absorption 52 of the laser pulse in the material, evaporation 53 of the surface material, and ionization 54 of the material. These three events take place advantageously within the duration of the laser pulse of—for example—approximately 10 ns.

In the case of direct laser marking in accordance with the prior art, the laser beam impinges directly on the metal surface, and the predominant part of the incident radiation is absorbed by the metal surface. This leads to severe heating of the surface, producing effects such as evaporation, melting and heating of the material. At the focus of the laser beam there is typically a high peak power, which in general produces heating to an extent far beyond the tempering temperature. As a result of different modes (energy ranges) in the focus, for example, of an Nd:YAG laser, it is therefore not possible to produce only a resultant temperature over the area of the irradiation. There is therefore a severe unavoidable heating of the metal surface.

The evaporation of material by means of a laser is known and is referred to as LTF (laser transfer methods) or PLD (pulsed lasers deposition). With both methods there is a deposition of the evaporated material on the target substrate. The result is a physicochemical bonding of the evaporated material.

In the case of the inventive coating of the metal surface with an absorption promoter, there is advantageously no material deposited permanently on the metal surface; instead, the evaporated material effects controlled heating of the surface of the target substrate to the tempering temperature. The absorption promoter permits rapid evaporation, and the "gas" formed continues to absorb energy within the laser pulse. The gaseous state of the ions and atoms is therefore converted into a plasma. Considering a laser pulse of 10 ns duration—see FIG. 2—the events of absorption, evaporation, and ionization take place within this pulse length or pulse duration. Thereafter the plasma cloud propagates spatially, a process, however, which is fairly slow in relation to the pulse length. After that the ions recombine with electrons to form neutral particles again, and there are also larger assemblies formed, such as clusters, nanoparticles or the like, for example. In the course of recombination and particle formation there is local occurrence of a thermally controlled heating of the target substrate.

Any residues in the condensation of the plasma are advantageously not fixed on the metal and can therefore be removed again advantageously and substantially without problems. A thermal process regime with an absorption promoter to the desired tempering temperature of the metal substrate takes place in a controlled way and without damage to the metal surface.

Figure 3:
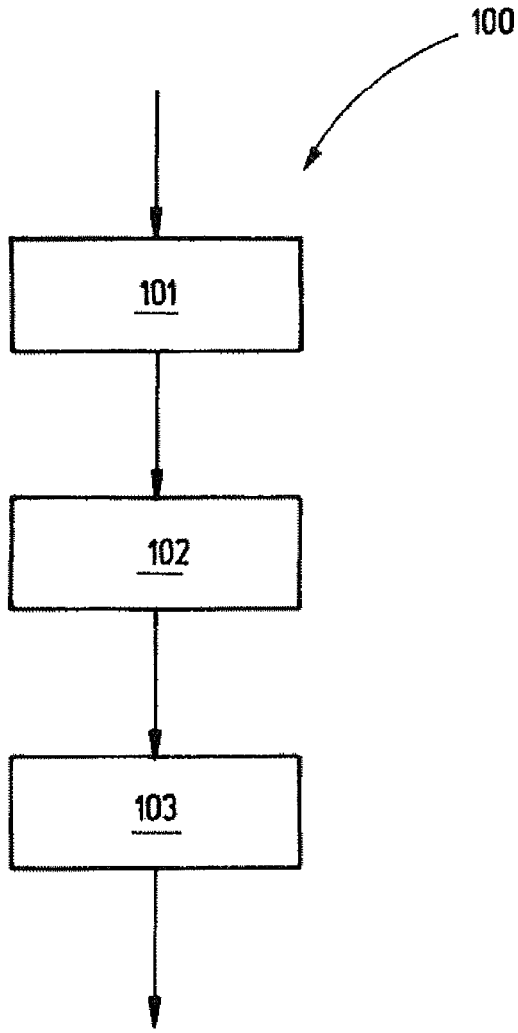
FIG. 3 shows a block diagram to represent the method of the invention.

FIG. 3 shows a block diagram 100 to illustrate a method of the invention for marking or inscribing a surface, such as, preferably, a metal surface.

A surface of a metal, which may have been cleaned beforehand, is coated in block 101 with an absorption promoter. A distance d between absorption promoter and surface may be achieved here by means of an intermediate layer applied beforehand or simultaneously. Coating takes place preferably substantially only in areas where subsequent marking or inscription is to be performed. Alternatively the coating may also take place extensively. In this context it is possible for the coating to be able to be applied as an application of coating material or as an adherable or attaching film. In block 102 the coated surface is heated selectively by means of a laser pulse, and so the metal surface is heated above the tempering temperature at the sites at which the laser pulse is applied.

After the laser-induced heating and color-changing of the surface, the surface can optionally be cleaned again; see block 103. This may entail the removal of residues and/or of absorption promoter still present.

LIST OF REFERENCE NUMERALS

1 surface, metal surface
2 layer, absorption promoter
3 plasma
4 laser beam, high-energy beam
5 metal
6 oxidation process
7 intermediate layer
50 diagram
51 plot
52 absorption
53 evaporation
54 ionization
100 block diagram
101 block for coating
102 block for application of a high-energy beam, such as a laser beam
103 block for cleaning of the surface

The invention claimed is:

1. A method of marking or inscribing a surface, comprising the steps of:

providing a metal surface to be marked;

providing an absorption promoter;

providing an intermediate layer formed by a spacer, having a thickness d in the range from 25 to 100 μm, between the absorption promoter and the metal surface; and directing a high-energy beam to the absorption promoter and the metal surface, upon the high-energy beam impinging on the absorption promoter, the high energy beam is absorbed by the absorption promoter, converting the high energy beam into heat, forming locally a plasma cloud in the intermediate layer, which plasma cloud increases a temperature of the metal surface, causing an observable color change of the metal surface.

2. The method of claim 1, further comprising the step of cleaning the metal surface to remove residues, after the high-energy beam has been applied.

3. The method of claim 1, wherein the absorption promoter is an adherable film.

4. The method of claim 1, wherein the absorption promoter is associated with surface regions of the metal surface that are subsequently to be marked or colored.

* * * * *